US009016813B2

(12) United States Patent
Moody et al.

(10) Patent No.: US 9,016,813 B2
(45) Date of Patent: Apr. 28, 2015

(54) FLOATING TIME BAR

(71) Applicant: Electrolux Home Products, Inc., Charlotte, NC (US)

(72) Inventors: William Lee Moody, Anderson, SC (US); Benjamin Mobley, Iva, SC (US); Christopher Baum, Piedmont, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 13/744,478

(22) Filed: Jan. 18, 2013

(65) Prior Publication Data

US 2014/0202273 A1 Jul. 24, 2014

(51) Int. Cl.

| | |
|---|---|
| ***A47B 96/04*** | (2006.01) |
| ***A47B 88/12*** | (2006.01) |
| ***F25D 25/02*** | (2006.01) |

(52) U.S. Cl.

CPC ..... *A47B 88/12* (2013.01); *F25D 25/025* (2013.01); *A47B 2210/0027* (2013.01); *A47B 2210/0078* (2013.01); *A47B 2210/175* (2013.01)

(58) Field of Classification Search

CPC ... F25D 25/025; F25D 25/022; F25D 23/021; A47B 2210/17; A47B 2210/175; A47B 2210/0067; A47B 2210/0078; A47B 88/10; A47B 88/14

USPC ..... 312/402, 404, 331; 403/361; 464/37

See application file for complete search history.

(56) References Cited

U.S. PATENT DOCUMENTS

| | | | | | |
|---|---|---|---|---|---|
| 2,620,253 | A | * | 12/1952 | Read et al. | 312/331 |
| 3,323,853 | A | * | 6/1967 | Stark | 312/331 |
| 4,591,214 | A | * | 5/1986 | Reuter et al. | 312/110 |
| 4,979,912 | A | * | 12/1990 | Shindo et al. | 439/595 |
| 5,399,045 | A | * | 3/1995 | Yoneda et al. | 403/321 |
| 5,595,509 | A | * | 1/1997 | Fry et al. | 439/752 |
| 6,059,598 | A | * | 5/2000 | Yamashita et al. | 439/352 |
| 6,116,938 | A | * | 9/2000 | Myer et al. | 439/353 |
| 6,217,365 | B1 | * | 4/2001 | Shinozaki | 439/358 |
| 6,851,775 | B2 | | 2/2005 | Kaiser | |
| 7,430,937 | B2 | | 10/2008 | Rotter et al. | |
| 7,677,125 | B2 | | 3/2010 | Rotter | |

(Continued)

FOREIGN PATENT DOCUMENTS

DE 202004016393 U1 12/2005

OTHER PUBLICATIONS

International Search Report and Written Opinion issued in Application No. PCT/US2014/011221 dated Apr. 24, 2014.

*Primary Examiner* — Hanh V Tran

(74) *Attorney, Agent, or Firm* — Pearne & Gordon LLP

(57) ABSTRACT

A rack-and-pinion mechanism includes a first rack and a second rack, a first pinion and a second pinion, and a timing bar. Each of the racks includes a first set of teeth provided longitudinally therealong. Each of the first pinion and the second pinion includes a second set of teeth provided circumferentially therearound. The first pinion and the second pinion are configured to rotate along the first rack and the second rack respectively through engagement of the second set of teeth with the first set of teeth. The timing bar includes a first end and a second end. The first end and the second end are configured to be coupled to the first pinion and the second pinion respectively so that the first and second pinions rotate as one. The first pinion is configured to be movable with respect to the timing bar along a longitudinal axis of the timing bar.

12 Claims, 2 Drawing Sheets

(56) References Cited

U.S. PATENT DOCUMENTS

| | | | | |
|---|---|---|---|---|
| 8,152,250 | B2 * | 4/2012 | Aguilar Ante et al. | 312/331 |
| 8,152,254 | B2 | 4/2012 | Kim | |
| 8,534,781 | B2 * | 9/2013 | Netzer et al. | 312/331 |
| 8,668,287 | B2 * | 3/2014 | Schwarzmann | 312/332 |
| 2008/0314067 | A1 * | 12/2008 | Lee | 62/441 |
| 2009/0026906 | A1 * | 1/2009 | Kim | 312/401 |
| 2009/0045713 | A1 * | 2/2009 | Kunkle et al. | 312/402 |
| 2009/0322470 | A1 * | 12/2009 | Yoo et al. | 340/3.1 |
| 2010/0007256 | A1 * | 1/2010 | Kim et al. | 312/408 |
| 2010/0236277 | A1 * | 9/2010 | Eom et al. | 62/449 |
| 2010/0283365 | A1 * | 11/2010 | Chen | 312/334.4 |
| 2011/0050065 | A1 * | 3/2011 | Lee et al. | 312/402 |
| 2011/0210655 | A1 * | 9/2011 | Brown et al. | 312/334.8 |
| 2011/0285266 | A1 * | 11/2011 | Rotter et al. | 312/402 |
| 2012/0125035 | A1 * | 5/2012 | Chellappan et al. | 62/340 |

* cited by examiner

FLOATING TIME BAR

TECHNICAL FIELD

The present disclosure relates to drawers for cabinets such as a refrigerator and, more particularly, to drawers that open and close by way of a rack-and-pinion mechanism.

BACKGROUND

Certain cabinets are built with drawers that are opened and closed through a rack-and-pinion mechanism. Specifically, the pinion rotates along the rack as the drawer moves in and out of the cabinet. The teeth of the pinion and the teeth of the rack mesh with one another to help the drawer open and close in a controlled manner and along straight lines. Moreover, a timing bar may further connect the pinions and synchronize rotation of the pinions.

An issue that may exist when connecting the timing bar to the rack-and-pinion mechanism is that the manufacturing process for the cabinet may result in some dimensional variation in the spacing between the interior walls of the cabinet such that the timing bar is rendered incompatible for mounting.

Therefore, there is a need for a way to adjust to any dimensional variation that can result from the manufacturing process of the cabinet.

SUMMARY

In one example aspect, a drawer assembly for an enclosure includes a first interior surface and a second interior surface which are opposite one another. The drawer assembly includes a first rack and a second rack, a drawer and a timing bar. The first rack and the second rack are mounted near the first interior surface and the second interior surface respectively. Each of the racks includes a first set of teeth provided longitudinally therealong. The drawer is configured to be movable in and out of the enclosure and includes a first face disposed near the first interior surface and a second face disposed near the second interior surface. The drawer includes a first pinion and a second pinion rotatably coupled near the first face and the second face respectively. Each of the pinions includes a second set of teeth provided circumferentially. The first pinion and the second pinion are configured to rotate along the first rack and the second rack respectively through engagement of the second set of teeth with the first set of teeth. The timing bar includes a first end and a second end. The first end and the second end are configured to be coupled to the first pinion and the second pinion respectively so that the first and second pinions rotate as one. The first pinion is configured to be movable with respect to the timing bar along a longitudinal axis of the timing bar.

In one example of the example aspect, each of the pinions includes a neck portion. The timing bar is configured to engage the neck portions.

In another example of the example aspect, the first end of the timing bar includes a slit extending along the longitudinal axis. The first pinion includes an elongate protrusion that is configured to be inserted into the slit and is configured to be movable about the slit.

In yet another example of the example aspect, the protrusion has a T-shaped cross-section.

In yet another example of the example aspect, the second end of the timing bar includes a first screw hole. The second pinion includes a second screw hole extending through the neck portion. The first screw hole and the second screw hole are configured to accommodate a screw to fixedly mount the second pinion to the timing bar.

In yet another example of the example aspect, the timing bar has a U-shaped cross-section configured to at least partially surround the neck portion.

In yet another example of the example aspect, the second pinion is fixedly mounted to the timing bar.

In yet another example of the example aspect, the enclosure is a refrigerated space.

In another example aspect, a rack-and-pinion mechanism includes a first rack and a second rack, a first pinion and a second pinion, and a timing bar. Each of the racks includes a first set of teeth provided longitudinally therealong. Each of the first pinion and the second pinion includes a second set of teeth provided circumferentially therearound. The first pinion and the second pinion are configured to rotate along the first rack and the second rack respectively through engagement of the second set of teeth with the first set of teeth. The timing bar includes a first end and a second end. The first end and the second end are configured to be coupled to the first pinion and the second pinion respectively so that the first and second pinions rotate as one. The first pinion is configured to be movable with respect to the timing bar along a longitudinal axis of the timing bar.

In one example of the another example aspect, each of the pinions includes a neck portion, the timing bar configured to engage the neck portions.

In another example of the another example aspect, the first end of the timing bar includes a slit extending along the longitudinal axis. The first pinion includes an elongate protrusion which is configured to be inserted into the slit and is configured to be movable about the slit.

In yet another example of the another example aspect, the protrusion has a T-shaped cross-section.

In yet another example of the another example aspect, the second end of the timing bar includes a first screw hole. The second pinion includes a second screw hole extending through the neck portion. The first screw hole and the second screw hole are configured to accommodate a screw to fixedly mount the second pinion to the timing bar.

In yet another example of the another example aspect, the timing bar has a U-shaped cross-section configured to at least partially surround the neck portion.

In yet another example of the another example aspect, the second pinion is fixedly mounted to the timing bar.

BRIEF DESCRIPTION OF THE DRAWINGS

These and other aspects are better understood when the following detailed description is read with reference to the accompanying drawings, in which.

DETAILED DESCRIPTION

Figure 1:
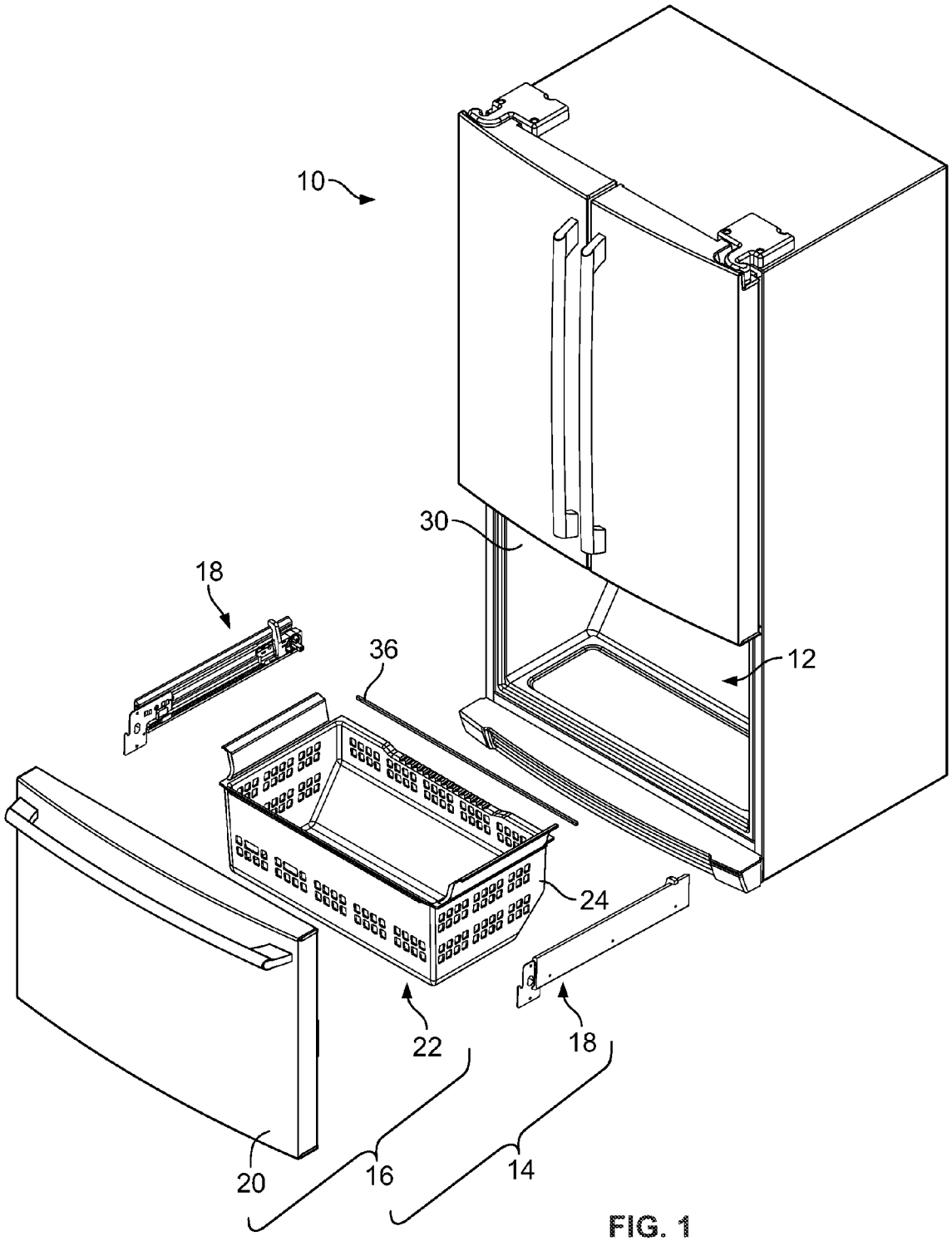
FIG. 1 is an exploded view of an example drawer assembly of an example cabinet structure.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein. It must be noted that the figures may not illustrate all of the features of the apparatus discussed herein and certain features may have been omitted for clarity of illustration.

Referring now to FIG. 1, a cabinet 10 for implementing the mechanism described herein is shown. The cabinet 10 shown in FIG. 1 is a home appliance and, more specifically, a refrigerator having a fresh-food compartment with French doors and a bottom-mounted freezer compartment although other embodiments can include refrigerators with an alternative arrangement of the compartments. The cabinet 10 can also be any other cabinet-like structure that provides a storage space or an enclosure and may be characterized as a drawer, a desk, a container, a chest, a safe, a cupboard or the like. The storage space of the cabinet 10 may provide a particular type of environment for items stored therein and, for example, may be configured to provide refrigeration, heating, sanitization, a vacuum, etc.

As shown in FIG. 1, an example enclosure 12 may accommodate a drawer assembly 14 which has a box-like configuration and is insertable in the enclosure 12. The enclosure 12 may be shaped to accommodate such a drawer assembly 14 and, in the present embodiment, the bottom-mounted freezer compartment is configured with the drawer assembly 14. The drawer 16 may have a shape other than that of a box and, for example, may be semi-cylindrical. As shown in FIG. 1, the enclosure 12 of the cabinet 10 may be provided such that the drawer 16 makes up the entire compartment and is accessed directly from the exterior of the cabinet 10 by pulling out the drawer 16. Alternatively, the drawer 16 may make up a part of the compartment and may need to be pulled out after a door of such a compartment is first opened.

FIG. 1 shows an exploded view of an example embodiment of the drawer assembly 14. In the present embodiment, the drawer assembly 14 includes a drawer 16 and a pair of motion control mechanisms 18. The drawer 16 may include a door portion 20 and a basket portion 22.

Figure 2:
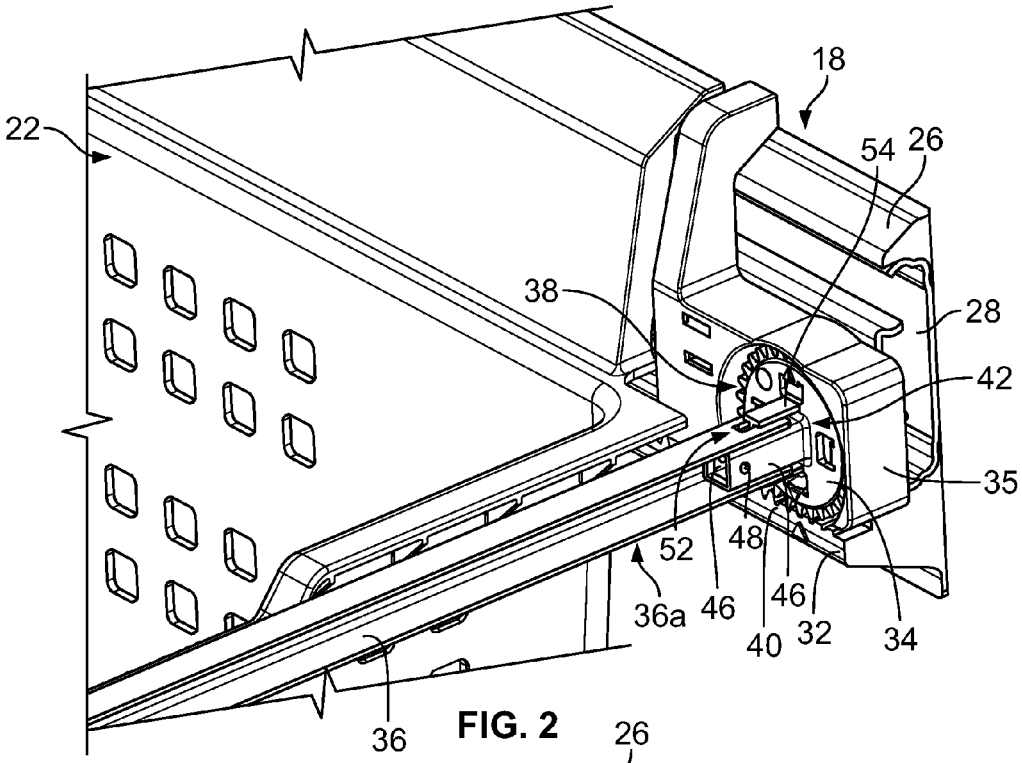
FIG. 2 is a close-up, rear perspective view of a first end of an example timing bar.

As shown in FIG. 1, the door portion 20 of the drawer 16 may conform in shape with other parts of the cabinet 10 and may include a grasping means, such as a handle, so that the drawer 16 can be manually pulled out of and pushed into the enclosure 12. Each motion control mechanism 18 allows the drawer 16 to move in and out of the enclosure 12 and a rack-and-pinion structure is provided to facilitate controlled, linear movement of the drawer 16. In the present embodiment, the motion control mechanism 18 includes a mounting bracket 26 about which a linear motion element 28 and the rack-and-pinion structure may be mounted. The mounting brackets 26 (FIGS. 2-3) may be mounted on or near two interior surfaces 30 which are disposed opposite one another in the enclosure 12. The drawer 16 may include faces 24 that are disposed adjacent the interior surfaces 30 when the drawer 16 is mounted on the cabinet 10. The motion control mechanisms 18 allow the drawer 16 to move between an extended, open position and a retracted, closed position. As shown in FIG. 2, the motion control mechanism 18 may also include the linear motion element 28, a rack 32 and a pinion 34. A timing bar 36 connects the motion control mechanisms 18 to help the linear motion elements 28 advance substantially equally on each side of the drawer 16. While the embodiment of FIG. 1 shows a basket portion 22 with faces 24 that are made of board, panels or sheets, the basket portion 22 may also be made of wires, cords or the like and the term "faces" is meant to apply to basket portions 22 with openings on the faces 24.

Figure 3:
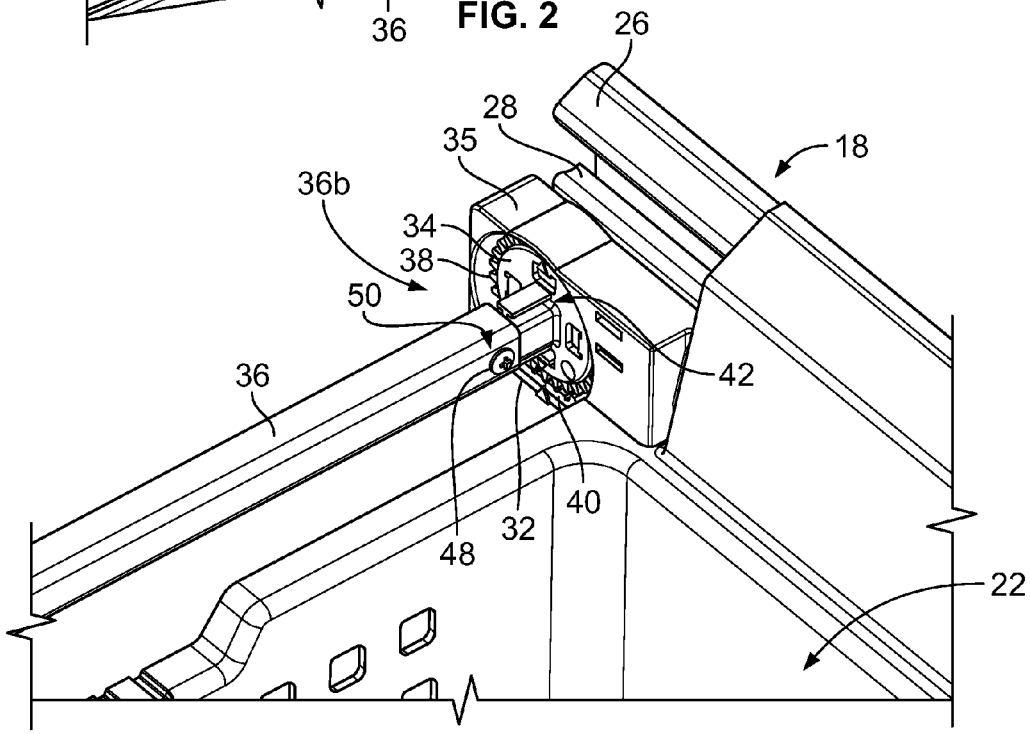
FIG. 3 is a close-up, front perspective view of a second end of the timing bar.

As shown in FIG. 2-3, the rack 32 may be provided on the mounting bracket 26 so as to be adjacent the linear motion elements 28 and the pinion 34. The pinion 34 may be surrounded by a housing 35 and may be rotatably coupled to the drawer 16 near the faces 24 and at a rear end of the basket portion 22. The linear motion element 28 may be a slide mechanism that allows the housing 35 and the pinion 34 to move relative to the rack 32 and may include a plurality of elongate members that can slide relative to one another. For example, the elongate members may be telescoping members that have varying cross-sections and are housed within one another in a retracted position. The cross-sectional shapes may vary and have a "U" or "C" shape, an oval shape, etc. The linear motion by the elongate members may be enabled using plain bearings, such as dovetail slides, ball bearings, roller bearings, or other means known in the art. The linear motion element 28 may utilize alternative structures such as wheels rolling about rails.

The elongate members may include a stationary member and a moving member that moves relative to the stationary member to move between the retracted position and the extended position. Alternatively, the elongate members may include one or more intermediate members linking the stationary member to the moving member but the stationary member and the moving member may still correspond to the outermost portions of the linear motion element in the extended position. The elongate members may include stopping means to limit the range of movement of one elongate member with respect to another. The stationary member may be provided with means to secure the stationary member directly or indirectly to the interior surface 30 while the moving member may be provided with means to secure the moving member directly or indirectly to the drawer 16 or the basket portion 22, for example, by engaging the housing 35. Such means may include screws, bolts, hooks, glue, etc.

For example, a bushing or adapter (not shown) may be rotatably coupled about a part of the moving member. The bushing may be mounted on an inner end of the moving member so as to undergo linear motion along with the drawer and move between the retracted position and the extended position. The bushing may include a male portion of a snap-in connection by which the bushing can become coupled to the moving member in a rotatable fashion. Moreover, the bushing may include an external section with female portions which may be engaged by male portions of the pinion. Alternatively, the male and female portions may be provided differently on the bushing and the pinion and it may be possible to rotatably couple to the pinion 34 to the bushing while coupling the bushing non-rotatably about the moving member.

As the drawer 16 moves in and out of the enclosure 12, the pinion 34 is allowed to rotate along the rack 32. The pinion 34 and the timing bar 36 may be configured to move with the drawer 16. The rack 32 may be provided on the mounting bracket 26 and is arranged to be parallel with the directions of the movement of the drawer 16 in and out of the enclosure 12. The rack 32 is provided longitudinally with a set of first teeth 38 which are adapted to mesh with a set of second teeth 40 that are circumferentially provided on the pinion 34. The housing 35 may be secured on the moving member of the linear motion element 18 so as to protect the rotation of pinion 34 from obstruction caused by items in the enclosure 12. The second teeth 40 may be substantially similar in height to the first teeth 38. The first teeth 38 may be provided longitudinally along a top edge of the rack 32. Alternatively, it may be possible to position the rack 32 above the pinion 34 and provide the first teeth 38 along the lower edge of the rack 32 oriented in downward directions. The pinions 34 near each interior surface 30 of the enclosure 12 are coupled to one another through the timing bar 36 in order to ensure that the pinions 34 rotate as one undergoing the same angular rotation at all times. The timing bar 36 is configured to be substantially perpendicular to the directions of movement of the drawer 16 and to the racks 32.

The rack 32 and the pinion 34 may include additional features in order to further stabilize meshing between the first teeth 38 and the second teeth 40. For example, the rack 32 may include a groove that extends along the first teeth 38 while the pinion 34 may include a wall that extends circumferentially across the second teeth 40. Although the wall extends through the center of the second teeth 40 while the groove extends through the center of the first teeth 38 in this embodiment, the location of the wall and the corresponding location of the groove may be moved to locations other than the center. The wall is configured to mate with and be guided by the groove as the pinion 34 rotates and moves along the rack 32. The height of the wall may be configured to be similar to or shorter than the depth of the groove. Moreover, the wall may be similar in height to the second teeth 40. The dimensions of the groove and the wall may be adjusted such that there is little play between the groove and the wall and the meshing between the first teeth 38 and the second teeth 40 is ensured through the length of the rack 32. Similarity between the width of the groove and the width of the wall and/or similarity between the depth of the groove and the height of the wall may also contribute in this respect. The similarity may be such that the width of the groove and the width of the wall and/or the depth of the groove and the height of the wall are substantially matching. While this embodiment shows the groove provided on the rack 32 and the wall provided on the pinion 34, the groove may be provided on the pinion 34 and the wall may be provided on the rack 32 instead.

In order to ensure that the pinion 34 is mounted at identical locations on each rack 32 on both sides of the drawer 16 during assembly, the rack 32 may be provided with a first marking and the pinion 34 may be provided with a second marking. The first marking may indicate a predetermined location along the length of the rack 32 at which the pinion 34 should engage the rack 32 when these two components are assembled together and the second marking may indicate a predetermined angular position of the pinion 34 for such an assembly. The markings may be configured on portions of the pinion 34 and the rack 32 that are visible to allow an assembly line worker to properly align the parts and, for example, may be provided on a side surface of the pinion 34 and a side surface of the rack 32. The markings can be embodied through engraving, printing, or other means known in the art and may have shapes that can indicate a state of alignment such as an arrow, a triangle, a line or the like.

Additionally, the drawer assembly 14 may include various other features that may enhance the ease of manufacturing, reduce the likelihood of problems during operation, etc. U.S. patent application Ser. No. 12/714,114 and Ser. No. 13/448,619 describe some of these features and are hereby incorporated by reference.

In order to allow for the drawer assembly 14 to compensate dimensional variations arising from the spacing between the interior surfaces 30 or other components, the drawer assembly 14 is configured as described in the following. The timing bar 36 may include a first end 36*a* and a second end 36*b*. Each of the first end 36*a* and the second end 36*b* of the timing bar 36 is configured to engage the neck portion 42 of the pinions 34. As shown in FIG. 2, the timing bar 36 may have a U-shaped cross-section which is dimensioned to accommodate the neck portion 42 so that the neck portion 42 is partially surrounded by the U-shaped cross-section. The U-shaped cross-section of the timing bar 36 may facilitate assembly with the neck portions 42 although the timing bar 36 may have cross-sections of different shapes (e.g., a hollow rectangle) with neck portions 42 having corresponding shapes. The neck portion 42 may be identical on both pinions 34 and may have a rectangular cross-section. As shown in FIG. 2, the neck portion 42 may include a second screw hole 44 that is located on a wall 46 of the neck portion 42. An opposite wall 46 of the neck portion 42 may also include the second screw hole 44 and the two screw holes 44 may be aligned to accommodate a screw 48 inserted therethrough. As shown in FIG. 3, the first end 36*a* or the second end 36*b* of the timing bar 36 may also include a first screw hole 50 such that the timing bar 36 can be secured to the neck portion 42 with the screw 48 that is inserted through the first screw hole 50 on the timing bar 36 and the second screw holes 44 on the neck portion 42.

As shown in FIG. 2, the first end 36*a* of the timing bar 36 includes a slit 52 that extends along the longitudinal axis of the timing bar 36 while the second end of the timing bar 36 does not. The neck portion 42 of at least one of the pinions 34 may include an elongate protrusion 54 with a portion that can be inserted into the slit 52 so that the neck portion 42 is movable relative to the slit 52. The protrusion 54 may be configured as a wall, a beam, a truss or the like as long as the protrusion 54 includes a feature that can be inserted into the slit 52. For example, the protrusion 54 may have a T-shaped cross-section. The protrusion 54 may be provided on both neck portions 42 while the slit 52 may be provided only on the first end 36*a* of the timing bar 36.

Thus, the protrusion 54 on the first pinion 34 is engaged by the slit 52 formed on the first end 36*a* of the timing bar 36 while the neck portion 42 of the second pinion 34 is fixedly mounted to the second end 36*a* of the timing bar 36 by way of the screw 48. Under such a configuration, the first pinion 34 is free to move relative to the timing bar 36 along the longitudinal axis of the timing bar 36 while the second pinion 34 is fixed about the timing bar 36. The position of the first pinion 34 relative to the first end 36*a* can be altered within a range that is meant to compensate for any variation in the spacing between the interior surfaces 30 arising from the manufacturing process of the cabinet 10.

It will be apparent to those skilled in the art that various modifications and variations can be made without departing from the spirit and scope of the claimed invention.

What is claimed is:

1. A drawer assembly for an enclosure including a first interior surface and a second interior surface, the interior surfaces being opposite one another, the drawer assembly including:

a first rack and a second rack mounted near the first interior surface and the second interior surface respectively, each of the racks including a first set of teeth provided longitudinally therealong;

a drawer configured to be movable in and out of the enclosure and including a first face disposed near the first interior surface and a second face disposed near the second interior surface, the drawer including a first pinion and a second pinion rotatably coupled near the first face and the second face respectively, each of the pinions including a second set of teeth provided circumferentially, the first pinion and the second pinion configured to rotate along the first rack and the second rack respectively through engagement of the second set of teeth with the first set of teeth; and a timing bar including a first end and a second end, the first end and the second end coupled to the first pinion and the second pinion respectively so that the first and second pinions rotate as one, the first end of the timing bar including a sidewall and a slit extending from the first end and through the sidewall and along a longitudinal axis of the timing bar, and the first pinion including a neck portion and an elongate protrusion formed at a surface of the first pinion, the neck portion is configured to be inserted into the timing bar and the protrusion is configured to be inserted into the slit to extend through the sidewall of the timing bar and be movable about the slit so that the first pinion is movable with respect to the timing bar along the longitudinal axis of the timing bar, and the second pinion is fixedly mounted to the timing bar.

2. The drawer assembly of claim 1, each of the pinions including a neck portion, the timing bar configured to engage the neck portions.

3. The drawer assembly of claim 1, the protrusion having a T-shaped cross-section.

4. The drawer assembly of claim 2, the second end of the timing bar including a first screw hole, the second pinion including a second screw hole extending through the neck portion, the first screw hole and the second screw hole configured to accommodate a screw to fixedly mount the second pinion to the timing bar.

5. The drawer assembly of claim 2, the timing bar having a U-shaped cross-section configured to at least partially surround the neck portion.

6. The drawer assembly of claim 1, wherein the enclosure is a refrigerated space.

7. A rack-and-pinion mechanism, including:

a first rack and a second rack, each of the racks including a first set of teeth provided longitudinally therealong;

a first pinion and a second pinion, each of the pinions including a second set of teeth provided circumferentially therearound, the first pinion and the second pinion configured to rotate along the first rack and the second rack respectively through engagement of the second set of teeth with the first set of teeth; and a timing bar including a first end movably mounted to the first pinion and a second end fixedly mounted to the second pinion, the first end and the second end coupled to the first pinion and the second pinion respectively so that the first and second pinions rotate as one, the first end of the timing bar including a sidewall and a slit extending from the first end and through the sidewall and along a longitudinal axis of the timing bar, the first pinion including a neck portion and an elongate protrusion formed at a surface of the first pinion, the neck portion is configured to be inserted into the timing bar and the protrusion is configured to be inserted into the slit to extend through the sidewall of the timing bar and be movable about the slit, wherein the timing bar includes the slit for receiving the protrusion only on the first end of the timing bar, the first pinion configured to be movable with respect to the timing bar along the longitudinal axis of the timing bar and the second pinion configured to be fixed with respect to the timing bar along the longitudinal axis of the timing bar.

8. The mechanism of claim 7, each of the pinions including a neck portion, the timing bar configured to engage the neck portions.

9. The mechanism of claim 7, the protrusion having a T-shaped cross-section.

10. The mechanism of claim 8, the second end of the timing bar including a first screw hole, the second pinion including a second screw hole extending through the neck portion, the first screw hole and the second screw hole configured to accommodate a screw to fixedly mount the second pinion to the timing bar.

11. The mechanism of claim 8, the timing bar having a U-shaped cross-section configured to at least partially surround the neck portion.

12. The mechanism of claim 7, wherein the protrusion is formed as a separate piece of the neck portion.

* * * * *

UNITED STATES PATENT AND TRADEMARK OFFICE

CERTIFICATE OF CORRECTION

PATENT NO. : 9,016,813 B2
APPLICATION NO. : 13/744478
DATED : April 28, 2015
INVENTOR(S) : William Lee Moody et al.

It is certified that error appears in the above-identified patent and that said Letters Patent is hereby corrected as shown below:

Title page, (54) and in the specification, column 1, "Floating Time Bar" should read -- Floating Timing Bar --.

Signed and Sealed this
Twenty-ninth Day of December, 2015

Michelle K. Lee

Michelle K. Lee
*Director of the United States Patent and Trademark Office*